US006606925B1

(12) United States Patent
Gmeilbauer

(10) Patent No.: US 6,606,925 B1
(45) Date of Patent: Aug. 19, 2003

(54) HANDLE FOR A HAND TOOL, ESPECIALLY A SCREWDRIVER GRIP

(76) Inventor: Engelbert Gmeilbauer, Stocketweg 1, Seefeld (DE), D-82229

( * ) Notice: Subject to any disclaimer, the term of this patent is extended or adjusted under 35 U.S.C. 154(b) by 0 days.

(21) Appl. No.: 09/674,798

(22) PCT Filed: May 4, 1999

(86) PCT No.: PCT/DE99/01327

§ 371 (c)(1),
(2), (4) Date: Nov. 6, 2000

(87) PCT Pub. No.: WO99/56916

PCT Pub. Date: Nov. 11, 1999

(30) Foreign Application Priority Data

May 4, 1998 (DE) ..... 298 07 944 U

(51) Int. Cl.[7] ..... B25B 23/16
(52) U.S. Cl. ..... 81/177.1; 81/177.2; 81/439
(58) Field of Search ..... 81/177.1, 177.2, 81/177.5, 177.85, 489, 436, 439; D8/82, 83, 85, 107

(56) References Cited

U.S. PATENT DOCUMENTS

| | | | | | |
|---|---|---|---|---|---|
| D26,157 | S | * | 10/1896 | Lee | D8/85 |
| 797,609 | A | * | 8/1905 | Schade | 81/177.1 |
| 1,510,593 | A | * | 10/1924 | Harrold | 81/177.1 |
| 1,578,065 | A | * | 3/1926 | Bemus et al. | 81/177.2 |
| 1,578,114 | A | * | 3/1926 | Fegley | 81/177.2 |
| D197,915 | S | * | 4/1964 | Ayars | 81/439 |
| 3,850,056 | A | | 11/1974 | Allen | |
| 4,296,656 | A | * | 10/1981 | Ernst | D8/85 |
| 4,640,155 | A | | 2/1987 | Condon | |
| 4,856,387 | A | * | 8/1989 | Gibson | 81/124.7 |
| D339,040 | S | * | 9/1993 | Piecuch et al. | D8/26 |
| 5,588,169 | A | * | 12/1996 | Chuang | 81/177.2 |
| 5,713,252 | A | | 2/1998 | Iwinski et al. | |
| 5,743,737 | A | * | 4/1998 | Hawn et al. | 81/177.8 |

FOREIGN PATENT DOCUMENTS

| | | |
|---|---|---|
| DE | 85 36 345.6 | 3/1987 |
| DE | 36 36 025 | 7/1987 |
| FR | 2 508 367 | 12/1982 |

* cited by examiner

*Primary Examiner*—James G. Smith
(74) *Attorney, Agent, or Firm*—Ostrolenk, Faber, Gerb & Soffen, LLP

(57) ABSTRACT

A handle for hand tool, which handle includes an elongate handle body and at least two polygonal locating shanks provided on the handle body as to tool fasteners onto which commercially available inserts are fittable. The shanks include a first shank arranged on a first end face of the body coaxially with respect to a longitudinal axis of the handle body, and at least one further shank aligned at an angle and at a distance from the first shank in the longitudinal direction.

17 Claims, 2 Drawing Sheets

HANDLE FOR A HAND TOOL, ESPECIALLY A SCREWDRIVER GRIP

PRIORITY CLAIM

This is a U.S. national stage of application No. PCT/DE99/01327, filed on May 4, 1999. Priority is claimed on that application and on the following application Country: Germany, Application No.: 298 07 944.5, Filed: May 4, 1998.

BACKGROUND OF THE INVENTION

1. Field of the Invention

The invention relates to a handle for a hand tool, especially a screwdriver grip, as used for example for various screwing jobs.

2. Discussion of the Prior Art

It is known to use screwdriver grips on the one end face of which different tool inserts or tool shanks with various active parts, for example supporting screwdrivers, cross-slotted screwdrivers, a hexagon/hexagon socket, can be exchangeably fastened, for example by means of a clamping sleeve. These handles cannot be used in conjunction with tool kits known per se, in particular ratchet screwdriver kits, which contain various button dies and bits. Moreover, in each case they can be used only in their classic form as screwdrivers, that is to say for screwing jobs in which relatively little force has to be exerted, while for greater torques it is necessary to resort to a T grip, or in situations were space is restricted, to a revolver grip. Consequently, three different tools have to be respectively provided for three different working situations.

German reference DE 36 36 025 C2 does indeed disclose a screwdriver grip in which a tool accessory, such as a hexagon-socket wrench, can be fastened on the grip part in two different settings, to be precise in a longitudinally axial position and a central position perpendicular to the latter, whereby a T grip is obtained. For these different types of arrangement, the tool insert has a head part, which can be push-inserted into a corresponding slot of the grip in different positions. Apart from the fact that, with this known grip, only a normal screwdriver function and a T-screwdriver function can be achieved, it also cannot be used for further commercially available tool inserts, since only tool inserts with the special head designed for this grip can be used.

SUMMARY OF THE INVENTION

The object of the invention is to provide a handle of the type mentioned above which is capable of being used in three different screwing/working positions, that is to say as a screwdriver, a T grip and a revolver grip, in rapid combination, with commercially available tools or inserts, button dies, bits, ratchets etc. and which, moreover, has a structure which is as simple as possible.

Accordingly, the handle according to the invention has, as provisions for fastening the various tool inserts on its handle body, at least two polygonal locating shanks, onto which the known tool inserts can be attached by being fitted on via their locating sleeves. In this case, a first shank is arranged on one end face of the tool body coaxially in longitudinal alignment so as to protrude, while at least one further shank, aligned at an angle and at a distance from the first shank, is provided. This provides a simple way of creating a multiple or multi-grip which, in combination with accessories offered inexpensively on the market, represents a multi-functional screwdriver quickly and easily, without special clamping provisions or special configurations.

It is particularly advantageous if three locating shanks are provided on the handle body, there being arranged in addition to the first shank, protruding in a longitudinally axial manner, a second shank perpendicular to the longitudinal axis and consequently in relation to the first shank and at the same time central to the longitudinal extent of the handle. As a result, the handle can be used as a T grip. Moreover, a third shank is arranged in the zone of the end face of the handle opposite the first shank, to be precise at an angle of 90 to 120° in relation to the alignment of the first shank or to the longitudinal axis of the handle, whereby a revolver grip can be provided. Particularly advantageous in this case is the 120° position, in which the shank terminates essentially at the end-face edge, obtaining a sloping revolver grip with a particularly good action.

The multi-grip according to the invention, which can consequently be used as a simple screwdriver, as a T grip and as a revolver grip, can be used as required for different torques on account of the different insert possibilities. It is also additionally possible to use a ratchet element, for example a freewheel ratchet button die according to DE 297 23 472 U1, directly or via a small adaptor plug-in part, it then being possible for the tool inserts to be fitted as required onto this ratchet. Consequently, the handle can be used in all three positions of use as a ratchet grip, in conjunction with a wide range of tool inserts. The handle can consequently be put together with. corresponding accessories to form a set, for example in a corresponding tool kit, which may include not only the screwdriver grip but also at least one ratchet element, various extensions, button dies, bits etc.

It is of advantage if the shanks in each case have a polygonal profile known per se, such as a square or hexagon profile, which interact with the corresponding inner square or inner hexagon profiles of the locating sleeves of the tool inserts or corresponding extensions or adaptor parts. It goes without saying that, in the case of an arrangement of square locating shanks in a corresponding tool set, at least one square/hexagon adaptor part is provided in order to allow tool inserts with different locating sleeves to be optimally used with the same handle.

In this case, the shanks may be arranged such that they are recessed into or protrude from the handle body to a greater or lesser extent. Therefore, they may protrude completely from the outer surface of the handle, in which case the respectively exposed length of the shank should be only slightly greater than the depth of the profile locating portion of the sleeve of the tool inserts.

The shanks may, however, also be recessed entirely or partially in the handle, in which case a coaxial, cylindrical recess is respectively provided around the shanks in the body for introducing the tool-locating sleeves. In this case, it is particularly advantageous and favorable during handling if all three shanks are recessed entirely in the handle, or at least the two shanks opening or protruding into the outer circumferential surface of the handle for the T and revolver positions. This has the effect that, in particular when the handle is being used as a classic screwdriver grip, the hand will not catch on the projecting shanks when the grip is being turned about its axis, so that injuries are avoided. The axial shank may in this case also be readily arranged in such a way that it partially or entirely protrudes from the surface, since this shank does not interfere any further with the handling of the handle.

According to the invention, the handle may be configured altogether in one piece, that is to say the shanks are arranged in or on the handle body and are, for example, cast onto the handle body during its production or worked from it subsequently.

The handle body may, however, also be produced from plastic, hard rubber, cast aluminum or other material which can be shaped, injection-molded, cast or sintered, the shanks being produced from steel or casting material and embedded in the material of the handle in a twist-resistant manner.

It is of advantage if the shanks produced from commercially available polygonal profiles, such as square or hexagon profiles, are embedded in the handle body in the form of polygonal inserts having at least two shanks and/or as individual polygonal inserts.

In this case, three individual shank inserts may be provided, in each case having a polygonal shank end and an anchorage end, with the anchorage end having a form which has been hammered out wide and flat or cut open and pressed out in an axially dovetail shape. The flat wide end or the spread-out dovetail end has the effect that a good twist- and shift-resistant anchorage of this shank takes place in the body material.

However, a single, one-part shank insert may also be provided, with three shanks, the steel profile configuration being such that two shanks are in each case provided on a correspondingly bent, commercially available profiled bar, while the third shank is provided on a second profiled bar, which is fastened on the first, bent profiled bar by adhesive bonding, welding or the like.

It is advisable here if the long part, i.e. the profiled bar bearing the axial shank and the 90° or 120° shank located at the opposite end, is a continuous profiled bar bent only at the 120° part, while the central T shank is a short bar which is welded onto the long bar. In this case, a transverse groove may be made in the long profiled bar at the level of the T shank, the inner end of the short profiled bar engaging in said groove with a form fit and a welded connection being realized by spot welding from the rear side. Therefore, there is also optimal twist resistance.

However, a shorter profiled bar, bent at both ends, may also be provided, having the T shank and the revolver shank, while the axially pointing screwdriver shank is a single insert. Consequently, the shanks subjected to the greater torque loading, that is to say the T shank and the revolver shank, are anchored in the body in an optimum way in terms of loading, while the single insert subjected to less loading is provided in the screwdriver position, which has to take up less torque.

For securely locating the tool inserts, arresting devices, such as spring-loaded balls or bolts, are respectively let radially into the handle shanks, in a way known per se, and interact with corresponding recesses in the tool insert sleeves.

Finally, there is the possibility of designing the handle body in terms of material in such a way that, in particular in the case of an arrangement of single shank inserts, a material reinforcement is provided in the corresponding insertion zones, in order to achieve a greater strength in these zones, avoiding breaking out of the single shank inserts under high loading.

BRIEF DESCRIPTION OF THE DRAWINGS

The invention is explained in more detail below on the basis of several exemplary embodiments with reference to the drawing, in which.

DETAILED DESCRIPTION OF THE PREFERRED EMBODIMENTS

Figure 1:
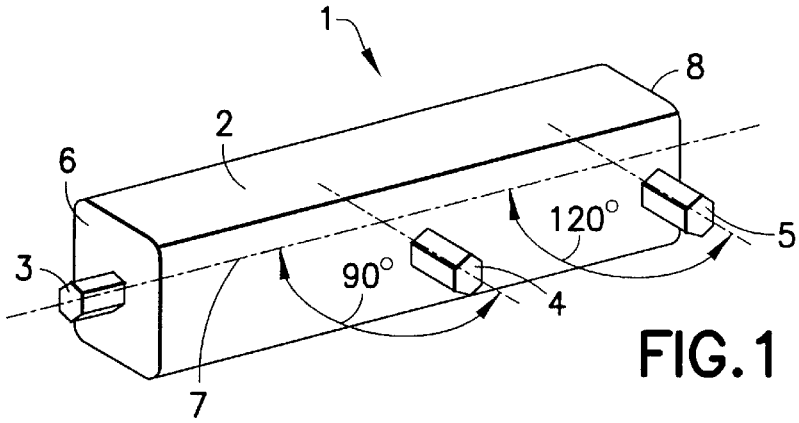
FIG. 1 shows a perspective view of a handle according to the invention in a first configuration—with hexagon shanks protruding completely from the handle body—

As can be seen from FIG. 1, the handle 1 according to the invention comprises an elongate handle body 2, on which three locating shanks 3, 4, 5 are arranged. In the first embodiment represented here, the shanks 3, 4, 5 are designed as hexagon shanks, which protrude from the outer surfaces of the handle body in different positions with respect to one another and with respect to the handle body 2. For instance, the screwdriver shank 3 is arranged on the one end face 6 of the handle body 2, coaxially with respect to the longitudinal axis 7 of the body 2, while the T shank 4 is arranged essentially centrally with respect to the length of the body 2 and at the same time perpendicularly in relation to the circumferential surface of the body and the longitudinal axis 7. Moreover, the revolver shank 5 is arranged in the end zone 8, that is to say at the opposite end from the end face 6, to be precise essentially in the same plane as the two other shanks 3 and 4, but at an angle of 120° with respect to the screwdriver shank 3.

Figure 2:
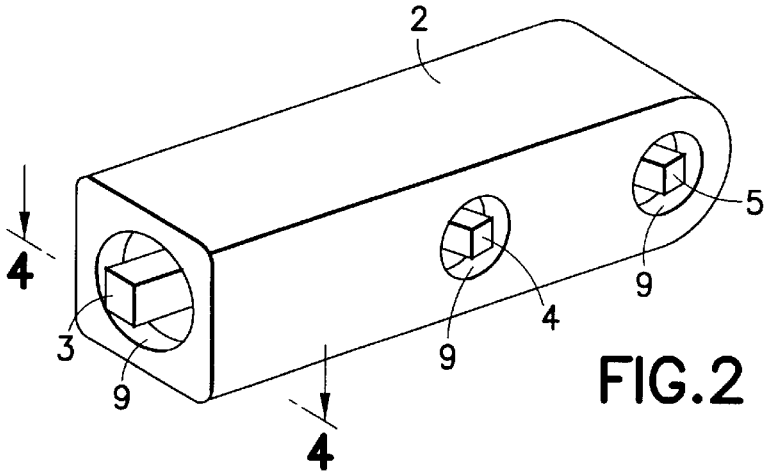
FIG. 2 shows a perspective view as in FIG. 1 of a handle in a second embodiment, with square shanks recessed in the handle body.
Figure 3:
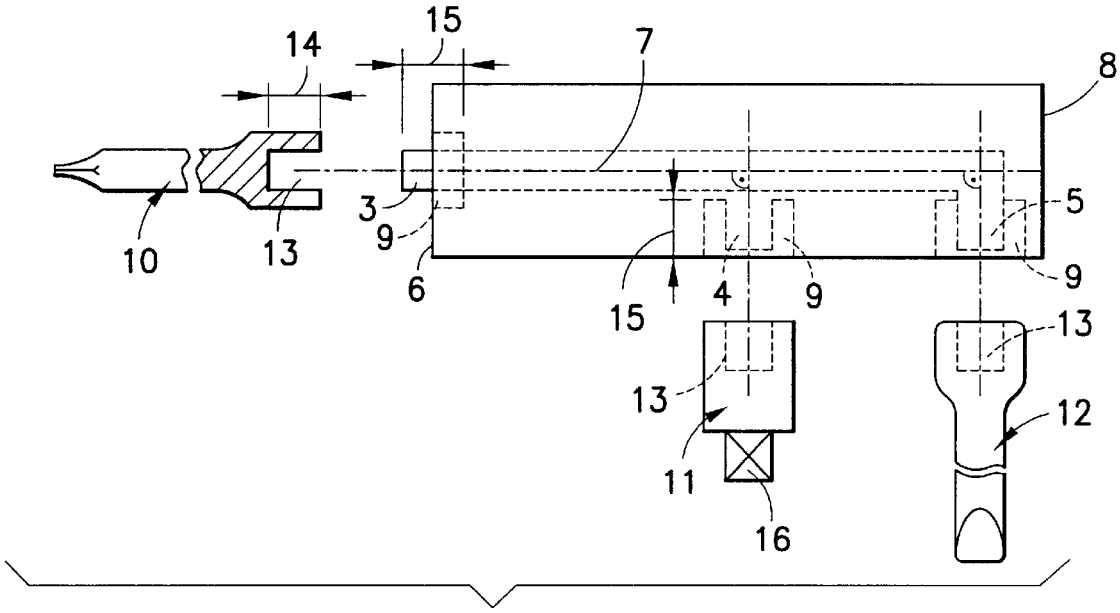
FIG. 3 shows a plan view of the handle from FIG. 2, with insert tools indicated in the insertion position—

In the case of the embodiment represented in FIGS. 2 and 3, the three shanks 3, 4, 5 are designed as square shanks, which are recessed at least partially in the handle. In this case, the shanks 3, 4, 5 are in each case surrounded by a cylindrical clearance 9, which is concentric to the shanks and, with respect to its depth, depends on how far the shank is recessed in the handle body, that is to say to what extent the end face of the shank is arranged such that it protrudes beyond the corresponding body surface or is set back in relation to the latter. For instance, here the shank 3 is only half-recessed, while the shanks 4 and 5 are completely recessed, even slightly deeper than the circumferential surface of the body, to avoid injuries, in particular when the handle is handled as a screwdriver grip. It can also be seen that, in the exemplary embodiment according to FIGS. 2 and 3, the revolver shank 5 is arranged at an angle of 90° with respect to the longitudinal axis of the handle, close to the end face 8.

In FIG. 3, tool inserts 10, 11, 12 are also depicted, at least in an indicative way, in the coaxial insertion direction with respect to the respective shanks and it can be seen that they respectively have a locating sleeve 13, which has an inner profile corresponding to the respective shank profile, the sleeve profile depth 14 and the shank profile height 15 being approximately the same. It can also be seen that the ratchet element 11, to be fitted onto the shank 4 by means of its sleeve 13 in FIG. 3, likewise has at the opposite end face a locating shank 16, on which for example tool inserts 10, 12 can be fastened, so that a T-ratchet screwdriver is provided.

Figure 4:
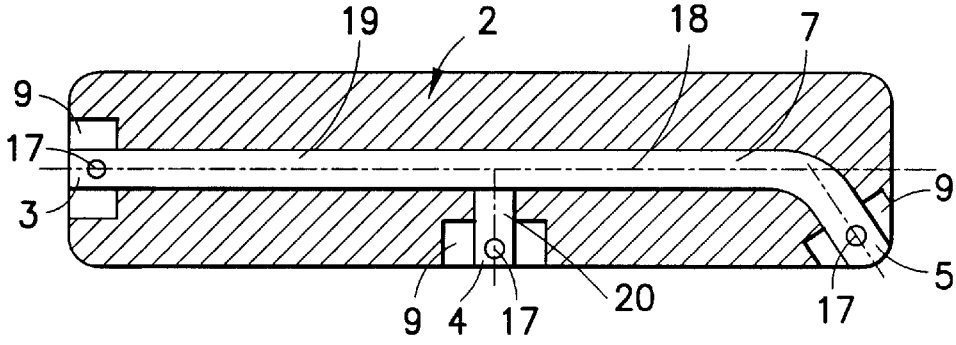
FIG. 4 shows a section IV—IV in FIG. 2, showing an embodiment with a one-piece, welded profiled insert by with three shanks—
Figure 5:
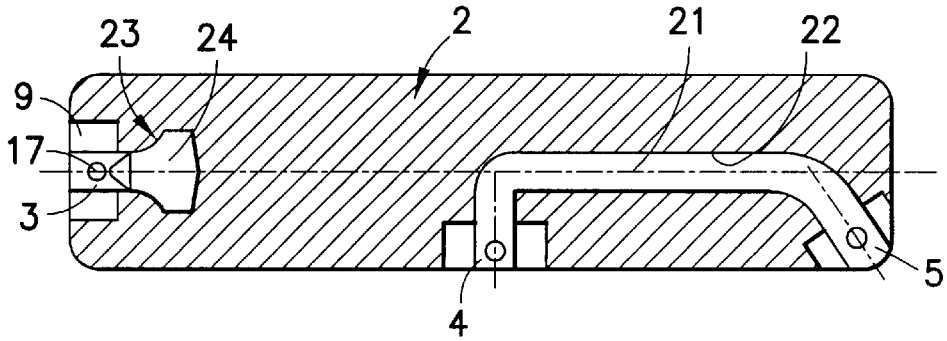
FIG. 5 shows a section as in FIG. 4, through an embodiment with a short profiled insert with two shanks for the T and revolver positions and a single insert shank for the axial screwdriver position
Figure 6:
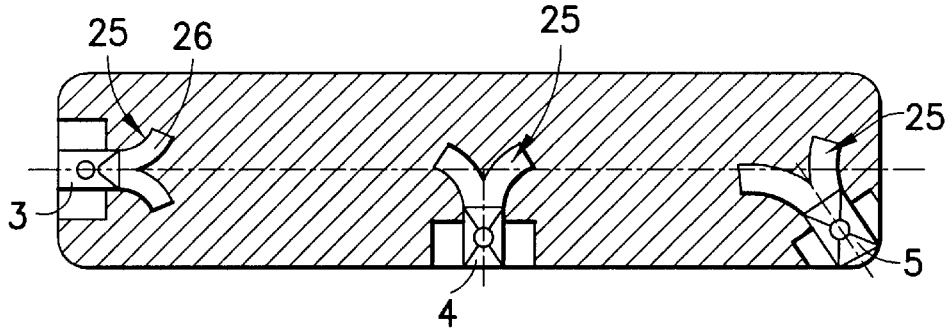
—and FIG. 6 shows a section as in FIG. 4 through an exemplary embodiment with three individual shank inserts.

In the case of the three embodiments represented in FIGS. 4 to 6, the shanks 3, 4, 5 arranged in the handle body 2 are respectively arranged at the same angular position (0°, 90°, 120°) with respect to the longitudinal axis 7 of the handle. They have in each case an arresting device 17, which, in a way known per se, comprises, for example, a radially recessed, spring-loaded ball. All three shanks 3, 4, 5 are in this case provided in such a way that they are completely recessed and are surrounded by concentric clearances 9 of the same depth in each case. The shanks 3, 4, 5 are provided by a polygonal insert, which comprises a long profiled bar 19, which is bent away at a 120° angle only at one end and, apart from the bent-away, short part, is coaxial with respect to the center axis 7 of the handle over virtually the entire length. A short profiled bar 20, which on one side has the T shank 4, is welded with its other side onto the long profiled bar 19 essentially centrally in such a way that the three shanks 3, 4, 5 lie in the same center plane of the handle body.

In the case of the embodiment according to FIG. 5, a two-shank insert 21 is provided, which comprises a U-profiled bar 22, on the two short 90° and 120° T legs of which the shanks 4 and 5 are respectively provided. Moreover, a single insert 23 is inserted coaxially in the end face 6 of the handle, having the shank 3 at its one end and a hammered flat or wide anchorage end 24 at its other end. A short profiled bar, for example a square profiled bar piece, which is pressed together or hammered on one side or symmetrically on two sides at its one end, toward the anchorage end 24, so that a shovel-shaped anchorage part is produced, can be used for fabricating this single insert. The other end is provided with an arresting device 17 and protrudes into the concentric clearance 9, here terminating essentially flush with the end face 6. It can be seen that the insert 21 can take a greater torque via its shanks 4, 5 than the single insert 23, which however does not heed to take such a high torque, since it merely bears the screwdriver shank 3.

Finally, it can be seen from FIG. 6 how in a further configuration three single inserts 25, which have a similar construction to the single insert 23 from FIG. 5, are provided in the handle body 2. The only difference is the design of the anchorage end, which is designed here as a dovetail-shaped anchorage end 26. It can be seen in this case that the anchorage end 26 has two arms pointing away from each other. However, three or more arms may also be provided, so that the anchorage end then has a plurality of anchorage prongs or a star-shaped appearance. These prongs may lie in the same plane, but may also be bent up in a diagonally opposite manner, for example by a cross incision. Finally, in approximation to the embodiment as an anchorage end 24 according to FIG. 5, the anchorage part may have, at least on one side, hammered-in channels, which prevent unwanted tearing out of the insert.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A handle for a hand tool, consisting of:

an elongate handle body, and three polygonal locating shanks provided on the handle body as tool fastening means onto which commercially available tool inserts are fittable via locator sleeves of the tools, the shanks including a first shank configured as an axial screwdriver shank arranged on a first end face of the body coaxially with respect to a longitudinal axis of the handle body, a second shank configured as a T-shank arranged perpendicular to the longitudinal axis and central to the handle body, and a third shank configured as a revolver shank arranged in a zone of a second end face of the body opposite the first end face at an angle of 90° to 120° with respect to the longitudinal axis, the shanks being recessed at least partially in the handle body.

2. A handle as defined in claim 1, wherein the third shank is arranged at an angle of 120° with respect to the first shank.

3. A handle as defined in claim 1, wherein the shanks have polygonal profiles which interact with corresponding polygonal profiles of locating sleeves of the tool inserts.

4. A handle as defined in claim 3, wherein the polygonal profiles are one of square and hexagonal.

5. A handle as defined in claim 1, wherein the shanks are recessed entirely in the handle body so that end faces of the shanks terminate essentially flush with an outer surface of the handle body, a cylindrical clearance for introducing the tool insert sleeves being respectively provided concentrically around each of the shanks.

6. A handle as defined in claim 1, wherein the first shank protrudes at least partially from the handle body while the second and third shanks are recessed entirely into the handle body.

7. A handle as defined in claim 1, wherein the handle is a single part.

8. A handle as defined in claim 7, wherein the handle is made of one of plastic and metal.

9. A handle as defined in claim 1, wherein the handle body is made of a material which can be shaped and the shanks are made of one of steel and a casting material and are embedded in the material of the handle in a twist-resistant manner.

10. A handle as defined in claim 9, wherein the handle body is made of one of plastic, hard rubber and cast aluminum.

11. A handle as defined in claim 9, wherein the shanks are embedded in the body as polygonal inserts having at least two shanks.

12. A handle as defined in claim 9, wherein the shanks in each case have a polygonal shank end and an anchorage end, the anchorage end having a form which one of has been hammered out wide and flat in a shovel shape and cut open in an axially dovetail shape.

13. A handle as defined in claim 9, wherein the three shanks are combined to from a one-part shank insert having a polygonal steel profile configuration such that the first and second shanks are in each case provided on a correspondingly bent profiled bar, while the third shank is provided on a second profiled bar which is fastened on the first profiled bar by at least one of a form fit, adhesive bonding, and welding.

14. A handle as defined in claim 9, wherein the second and third shanks are combined to form a U-profiled bar, the first shank being a separate element.

15. A handle as defined in claim 14, wherein the shanks of the U-profiled bar are respectively arranged at 90° to 120° relative to the longitudinal axis, while the first shank is at an angle of 0°.

16. A handle as defined in claim 1, wherein an arresting device is respectively set radially into the shanks so as to interact with corresponding recesses in tool insert sleeves.

17. A handle as defined in claim 9, wherein the shanks are separate elements embedded in the body.

* * * * *